US011356790B2

(12) United States Patent
Tsutsumi et al.

(10) Patent No.: US 11,356,790 B2
(45) Date of Patent: Jun. 7, 2022

(54) SOUND IMAGE REPRODUCTION DEVICE, SOUND IMAGE REPRODUCTION METHOD, AND SOUND IMAGE REPRODUCTION PROGRAM

(71) Applicant: Nippon Telegraph and Telephone Corporation, Tokyo (JP)

(72) Inventors: Kimitaka Tsutsumi, Musashino (JP); Kenichi Noguchi, Musashino (JP); Hideaki Takada, Musashino (JP); Yoichi Haneda, Musashino (JP)

(73) Assignee: Nippon Telegraph and Telephone Corporation, Tokyo (JP)

( * ) Notice: Subject to any disclaimer, the term of this patent is extended or adjusted under 35 U.S.C. 154(b) by 0 days.

(21) Appl. No.: 17/050,102

(22) PCT Filed: Apr. 15, 2019

(86) PCT No.: PCT/JP2019/016078
§ 371 (c)(1),
(2) Date: Oct. 23, 2020

(87) PCT Pub. No.: WO2019/208285
PCT Pub. Date: Oct. 31, 2019

(65) Prior Publication Data

US 2021/0105571 A1 Apr. 8, 2021

(30) Foreign Application Priority Data

Apr. 26, 2018 (JP) ..... JP2018-085142

(51) Int. Cl.
*H04S 7/00* (2006.01)
*H04R 3/12* (2006.01)
(Continued)

(52) U.S. Cl.
CPC ..... *H04S 7/30* (2013.01); *H04R 3/12* (2013.01); *H04R 5/02* (2013.01); *H04R 5/04* (2013.01)

(58) Field of Classification Search
CPC combination set(s) only.
See application file for complete search history.

(56) References Cited

U.S. PATENT DOCUMENTS 5,404,406 A * 4/1995 Fuchigami ..... H04S 1/002 381/26
7,813,933 B2 * 10/2010 Martin ..... H04S 3/002 704/502
(Continued)

FOREIGN PATENT DOCUMENTS

JP 2011-244306 12/2011

OTHER PUBLICATIONS

Sato et al., "Filter Design of a Circular Loudspeaker Array Considering the Three-Dimensional Directivity Patterns Reproduced by Circular Harmonic Modes," Convention Paper Presented at the 142nd Convention: Audio Engineering Society, Berlin, Germany, May 20-23, 2017, 10 pages.
(Continued)

*Primary Examiner* — Duc Nguyen
*Assistant Examiner* — Assad Mohammed
(74) *Attorney, Agent, or Firm* — Fish & Richardson P.C.

(57) ABSTRACT

Provided is a sound image reproduction device, sound image reproduction method, and sound image reproduction program that can support monaural sound sources and is capable of imparting directivity to virtual sound sources in a space. An acoustic signal processing device (sound image reproduction device) 1 that generates virtual sound sources in a space using multiple loudspeakers arranged in a straight line, includes: a focal-point position determination unit 12
(Continued)

that determines the position of each virtual sound source to generate multiple virtual sound sources in a circular arrangement; a filter-coefficient determination unit 13 that calculates an impulse response vector for each loudspeaker by performing an inverse Fourier transform on a driving function for each loudspeaker that is used to generate a virtual sound source at the position of each virtual sound source and in which different weights are given to some of the virtual sound sources; and a convolution calculation unit 14 that calculates the convolution of one inputted acoustic signal with the impulse response vector for each loudspeaker and outputs each acoustic signal to the corresponding the multiple loudspeakers.

6 Claims, 7 Drawing Sheets

(51) Int. Cl.
*H04R 5/02* (2006.01)
*H04R 5/04* (2006.01)

(56) References Cited

U.S. PATENT DOCUMENTS

2007/0154019 A1* 7/2007 Kim ..... H04R 5/04 381/310
2010/0098274 A1* 4/2010 Hannemann ..... H04R 1/403 381/300
2014/0348337 A1* 11/2014 Franck ..... H04R 29/001 381/59

OTHER PUBLICATIONS

Spors et al., "Physical and Perceptual Properties of Focused Sources in Wave Field Synthesis," Convention Paper Presented at the 127th Convention: Audio Engineering Society, New York, NY, Oct. 9-12, 2009, 19 pages.

* cited by examiner

SOUND IMAGE REPRODUCTION DEVICE, SOUND IMAGE REPRODUCTION METHOD, AND SOUND IMAGE REPRODUCTION PROGRAM

CROSS-REFERENCE TO RELATED APPLICATIONS

This application is a National Stage application under 35 U.S.C. § 371 of International Application No. PCT/JP2019/016078, having an International Filing Date of Apr. 15, 2019, which claims priority to Japanese Application Serial No. 2018-085142, filed on Apr. 26, 2018. The disclosure of the prior application is considered part of the disclosure of this application, and is incorporated in its entirety into this application.

TECHNICAL FIELD

The present invention relates to a sound image reproduction technique for generating virtual sound sources in a space.

BACKGROUND ART

In public screening or concerts, multiple loudspeakers installed in the screening venue reproduce sound, music, and the like. In recent years, efforts have been made to achieve more realistic acoustic reproduction than current ones by generating a virtually generated sound source (virtual sound source) in a screening space. In particular, to achieve highly realistic acoustic content, a loudspeaker array constituted of multiple loudspeakers arranged in a straight line is used to generate a virtual sound source that the audience feels being positioned near the audience seats located in front of the loudspeakers.

Since musical instruments and human voices, in general, radiate different levels of power depending on the directions, it is expected to achieve more realistic acoustic content by reproducing the difference in acoustic signal power according to the directions (directivity) when generating a virtual sound source in a screening space.

Such sound image reproduction techniques for generating a virtual sound source in a screening space include a method called wave field synthesis (patent document 1). In the method in patent document 1, the acoustic signal at the point for recording the acoustic signal is recorded with microphones placed at multiple points, and the incoming directions of the acoustic signal in the up-down and right-left directions are analyzed. The acoustic signal in the recording venue is physically reproduced by using multiple loudspeakers installed in the screening space.

There is another technique in which a sound source of a suction type (acoustic sink) is assumed for a virtual sound field, and driving signals based on driving functions derived from the Rayleigh integral of the first kind are given to a loudspeaker array to generate a virtual sound source in front of the loudspeakers (non-patent document 1).

In addition, as a method for modeling the directivity of a sound source, there is a known technique using a circular harmonic expansion method (non-patent document 2). Circular harmonic expansion is a method of expressing the directivity of sound by expanding an acoustic signal observed by an array of microphones arranged in a circle centered on a sound source into circular harmonic series. On the reproduction side, driving signals based on driving functions obtained from the circular harmonic series obtained on the recording side are used for an array of loudspeakers arranged in a circle, so that a sound source having a directional characteristic modeled on the recording side can be reproduced.

PRIOR ART DOCUMENT

Patent Document

Patent document 1: Japanese Patent Application Publication No. 2011-244306

Non-Patent Document

Non-patent document 1: Sascha Spors and three others, "Physical and Perceptual Properties of Focused Sources in Wave Field Synthesis", 127th Audio Engineering Society Convention paper 7914, October 2009

Non-patent document 2: Koya Sato and one other, "Filter design of a circular loudspeaker array considering the three dimensional directivity patterns reproduced by circular harmonic modes", 142nd Audio Engineering Society Convention paper 9765, May 2017

SUMMARY OF THE INVENTION

Problem to be Solved by the Invention

The technique disclosed in patent document 1 reproduces acoustic signals at a recording point with high fidelity, and hence it has high reproducibility in reproduction of a virtual sound source. However, the technique requires not only the loudspeaker array but a microphone array, increasing the scale of the entire system. In addition, since the invention is for reproducing recorded sound with high fidelity, it is difficult to edit content, for example, adding sound effects that do not exist in everyday life as special effects, which is typically seen in movies. Further, since acoustic signals generated by multiple sound sources are simultaneously enter a microphone in a mixed state, it is extremely difficult to make edits such as selecting individual sound sources and adjusting the positions and the tonal quality of the selected sound sources.

The technique disclosed in non-patent document 1 does not require a microphone array to generate a virtual sound source but is capable of generating a virtual sound source by generating acoustic signals the number of channels of which corresponds to the number of multiple loudspeakers, from a monaural sound source recorded with an ordinary microphone. Since the technique uses a monaural sound source, the scale of the entire system is small, and it is easy to edit content. However, since in the technique, the omnidirectional characteristic is assumed for the radiation characteristic of the virtual sound source, it is impossible to generate a sound source with directivity by using the virtual sound source.

The present invention has been made in light of the above situations, and an objective thereof is to provide a sound image reproduction device, sound image reproduction method, and sound image reproduction program that can support monaural sound sources and is capable of imparting directivity to virtual sound sources in a space.

Means for Solving the Problem

To solve the above problems, a sound image reproduction device according to claim 1 is a sound image reproduction device that generates virtual sound sources in a space using multiple loudspeakers arranged in a straight line, including: a focal-point position determination unit that determines the position of each virtual sound source to generate multiple virtual sound sources in a circular arrangement; a filter-coefficient determination unit that calculates an impulse response vector for each loudspeaker by performing an inverse Fourier transform on a driving function for each loudspeaker that is used to generate a virtual sound source at the position of each virtual sound source and in which different weights are given to some of the virtual sound sources; and a convolution calculation unit that calculates the convolution of one inputted acoustic signal with the impulse response vector for each loudspeaker and outputs each acoustic signal to the corresponding the multiple loudspeakers.

A sound image reproduction device according to claim 2 is a sound image reproduction device that generates virtual sound sources in a space using multiple loudspeakers arranged in a straight line, including: a focal-point position determination unit that determines the position of each virtual sound source to generate multiple virtual sound sources in a circular arrangement; a filter calculation unit that outputs weighted acoustic signals by calculating the convolution of one inputted acoustic signal with an impulse response vector for each loudspeaker calculated in advance by performing an inverse Fourier transform on a driving function for each loudspeaker that is used to generate a virtual sound source at the position of each virtual sound source and in which different weights are given to some of the virtual sound sources; a delay adjustment unit that, for each loudspeaker, delays the output time of the weighted acoustic signal by the time necessary for the sound to travel the distance between the loudspeaker and each of the multiple virtual sound sources and outputs the delayed acoustic signal for each of the multiple virtual sound sources; and a gain multiplication unit that, for each loudspeaker, multiplies the delayed acoustic signal for each of the multiple virtual sound sources by a gain determined by the distance between the loudspeaker and each of the multiple virtual sound sources and outputs the multiplication result.

A sound image reproduction device according to claim 3 is the sound image reproduction device according to claim 1 or 2, in which the driving function for each loudspeaker is a function obtained by performing, in advance, circular harmonic expansion on directional characteristics of the virtual sound sources for the multiple virtual sound sources to obtain an n-th order circular harmonic series; dividing, for each order, the n-th order circular harmonic series by a two-dimensional Green's function subjected to circular harmonic expansion for the virtual sound sources; summing the divided values to calculate a weighting factor for each virtual sound source; and calculating the weighted average of the driving functions for driving the loudspeakers with the weighting factor for each virtual sound source.

A sound image reproduction method according to claim 4 is a sound image reproduction method of generating virtual sound sources in a space using multiple loudspeakers arranged in a straight line, including: determining the position of each virtual sound source to generate multiple virtual sound sources in a circular arrangement; calculating an impulse response vector for each loudspeaker by performing an inverse Fourier transform on a driving function for each loudspeaker that is used to generate a virtual sound source at the position of each virtual sound source and in which different weights are given to some of the virtual sound sources; and calculating the convolution of one inputted acoustic signal with the impulse response vector for each loudspeaker and outputting each acoustic signal to the corresponding the multiple loudspeakers, in which the determining, the calculating of the impulse response vector, the calculating of the convolution, and the outputting are performed by a sound image reproduction device.

A sound image reproduction method according to claim 5 is a sound image reproduction method of generating virtual sound sources in a space using multiple loudspeakers arranged in a straight line, including: determining the position of virtual sound source to generate multiple virtual sound sources in a circular arrangement; outputting weighted acoustic signals by calculating the convolution of one inputted acoustic signal with an impulse response vector for each loudspeaker calculated in advance by performing an inverse Fourier transform on a driving function for each loudspeaker that is used to generate a virtual sound source at the position of each virtual sound source and in which different weights are given to some of the virtual sound sources; delaying, for each loudspeaker, the output time of the weighted acoustic signal by the time necessary for the sound to travel the distance between the loudspeaker and each of the multiple virtual sound sources and outputting the delayed acoustic signal for each of the multiple virtual sound sources; and multiplying, for each loudspeaker, the delayed acoustic signal for each of the multiple virtual sound sources by a gain determined by the distance between the loudspeaker and each of the multiple virtual sound sources and outputting the multiplication result, in which the determining, the outputting of the weighted acoustic signals, the delaying, the outputting of the delayed acoustic signal, the multiplying, and the outputting of the multiplication result are performed by a sound image reproduction device.

A sound image reproduction program according to claim 6 causes a computer to function as the sound image reproduction device according to any one of claims 1 to 3.

Effect of the Invention

The present invention makes it possible to provide a sound image reproduction device, sound image reproduction method, and sound image reproduction program that can support monaural sound sources and is capable of imparting directivity to virtual sound sources in a space.

MODE FOR CARRYING OUT THE INVENTION

The present invention characterized in that the present invention makes it possible to generate virtual sound sources in a circular arrangement in a space with a linear loudspeaker array using inputted acoustic signals and impart directivity to the virtual sound sources in a circular arrangement using a circular harmonic expansion method to expand acoustic signals into circular harmonic series.

Specifically, the present invention generates multiple virtual sound sources in a circular arrangement in front of a linear loudspeaker array to form a circular array of virtual sound sources by using the technique of non-patent document 1 and also gives a different weight to each virtual sound source of the circular array to provide virtual sound sources with a directivity by using the technique of non-patent document 2.

Hereinafter, embodiments that implement the present invention will be described with reference to the drawings.

First Embodiment

Figure 1:
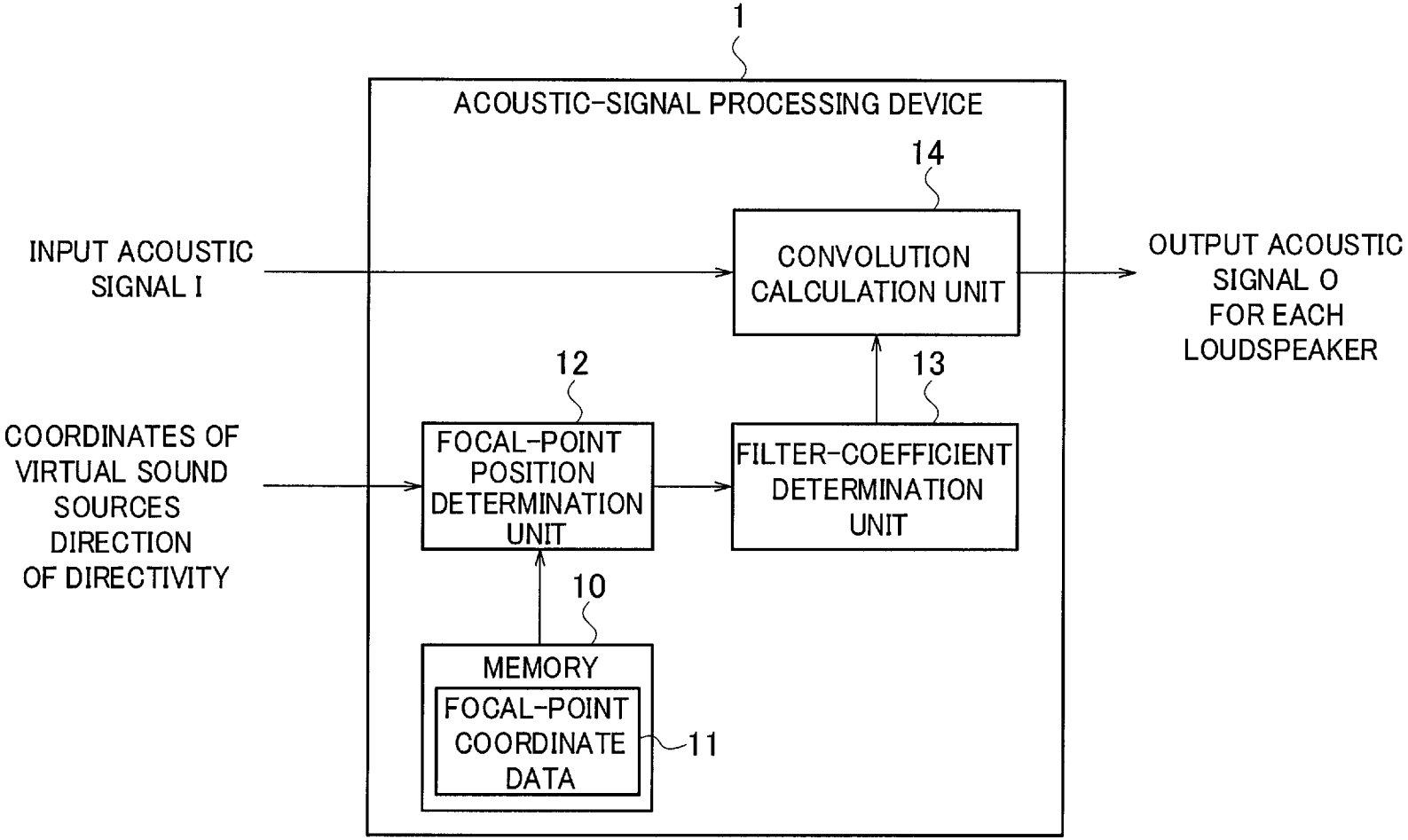
FIG. 1 is a diagram illustrating the functional block configuration of an acoustic-signal processing device according to a first embodiment.

FIG. 1 is a diagram illustrating the functional block configuration of an acoustic-signal processing device 1 according to a first embodiment. The acoustic-signal processing device (sound image reproduction device) 1 is a general computer including a processing device (not illustrated) and a memory 10. The functions illustrated in FIG. 1 are implemented by a general computer executing an acoustic-signal processing program (sound image reproduction program).

The acoustic-signal processing device 1 receives input of an input acoustic signal I from a monoaural sound source and provides virtual sound sources that the audience feels being positioned in front of the loudspeakers and that have directivity, by using a linear loudspeaker array constituted of multiple loudspeakers arranged in a straight line. To provide such virtual sound sources, the acoustic-signal processing device 1 converts the input acoustic signal I from the monaural sound source into an output acoustic signal O for each loudspeaker of the linear loudspeaker array.

The acoustic-signal processing device 1, as illustrated in FIG. 1, includes the memory 10, a focal-point position determination unit 12, a filter-coefficient determination unit 13, a convolution calculation unit 14, and an input-output interface (not illustrated).

The input-output interface is for inputting the input acoustic signal I from the monaural sound source to the acoustic-signal processing device 1 and outputting the output acoustic signal O to each loudspeaker. The input-output interface inputs information pieces on the coordinates of the virtual sound sources and the direction of the directivity that the acoustic-signal processing device 1 provides, to the acoustic-signal processing device 1.

The memory 10 stores focal-point coordinate data 11. The focal-point coordinate data 11 includes coordinate information to provide virtual sound sources (hereinafter, also referred to as focused sound sources) in a space. The focal-point coordinate data 11 includes coordinates in an absolute coordinate system having an X-axis that is the direction of the row of the loudspeakers in the linear arrangement and a Y-axis that is the front direction of the loudspeakers in the linear arrangement. The focal-point coordinate data 11 includes coordinates in a relative coordinate system having an origin O' that is the center of the multiple focused sound sources generated in a circular arrangement in the absolute coordinate system and an X'-axis and a Y'-axis that are axes passing the origin O' and respectively parallel with the X-axis and the Y-axis of the absolute coordinate system.

The focal-point position determination unit 12 receives information pieces on the coordinates of the virtual sound sources, the direction of the directivity, and target frequencies and outputs the coordinates for a predetermined necessary number of focal points. The focal-point position determination unit 12 determines the coordinate position of each focused sound source for generating multiple focused sound sources in a circular arrangement. The focal-point position determination unit 12 obtains the coordinate position of each of the multiple focused sound sources generated in a circular arrangement in a space of the absolute coordinate system and determines the polar coordinates of each of the multiple focused sound sources in the relative coordinate system using the focal-point coordinate data 11 stored in the memory 10.

For example, assuming that the coordinates $X_s$ of the s-th one of the focused sound sources generated in a circular arrangement in the space of the absolute coordinate system are $(x_s, y_s)$, the focal-point position determination unit 12 determines the polar coordinates $X_s=(r_s, \varphi_s)$ in the relative coordinate system corresponding to the coordinates $X_s=(x_s, y_s)$ in the absolute coordinate system, where $r_s$ is the distance from the origin O' of the relative coordinate system to the coordinates $X_s$, and $\varphi_s$ is the counter-clockwise angle from the X'-axis of the relative coordinate system.

Figure 2:
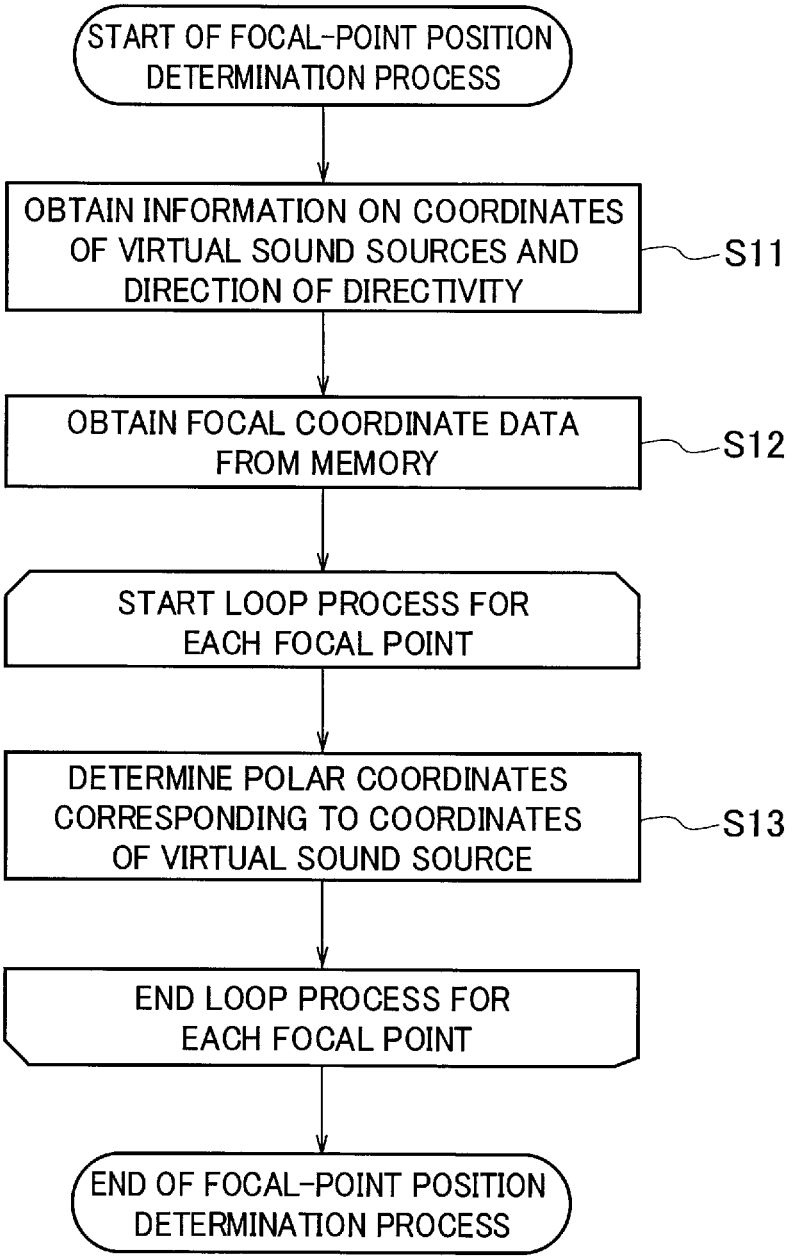
FIG. 2 is a diagram illustrating the procedure for a focal-point determination process according to the first embodiment.
Figure 3:
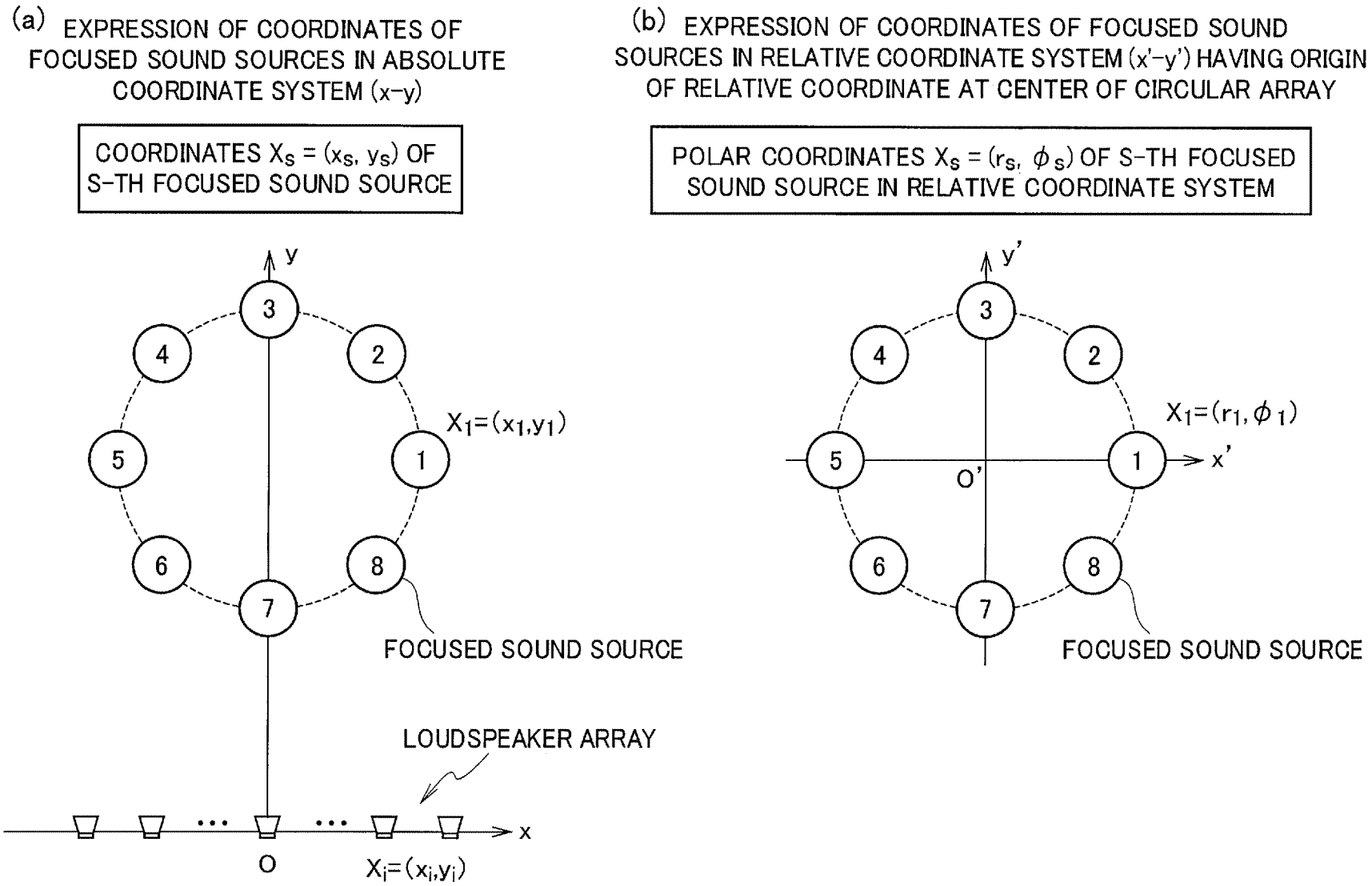
FIG. 3 shows diagrams illustrating an example of the coordinate positions of focused sound sources in an absolute coordinate system and a relative coordinate system according to the first embodiment.

Next, a focal-point determination process by the focal-point position determination unit 12 will be described. FIG. 2 is a diagram illustrating the procedure for the focal-point determination process. FIG. 3 shows diagrams illustrating an example of the coordinate positions of focused sound sources in the absolute coordinate system and the relative coordinate system.

First, at step S11, the focal-point position determination unit 12 obtains information pieces on the coordinates of the virtual sound sources to be generated in a circular arrangement in the space of the absolute coordinate system and the direction of the directivity, and at step S12, the focal-point position determination unit 12 reads the focal-point coordinate data 11 from the memory 10.

Next, at step S13, for the coordinates $X_1=(x_1, y_1)$ of the first one of the focused sound sources generated in a circular arrangement in a space of the absolute coordinate system, the focal-point position determination unit 12 determines the polar coordinates $X_1=(r_1, \varphi_1)$ in the relative coordinate system corresponding to the coordinates $X_1=(x_1, y_1)$ in the absolute coordinate system, using the focal-point coordinate data 11.

After that, the focal-point position determination unit 12 performs step S13 for each of the multiple focused sound sources, and after step S13 is performed for all of the focused sound sources in the predetermined number, the process ends.

After the focal-point position determination unit 12 calculates the polar coordinates in relative coordinate system of each of the multiple focused sound sources generated in a circular arrangement in the space of the absolute coordinate system, the polar coordinates are processed by the filter-coefficient determination unit 13.

The filter-coefficient determination unit 13 receives the polar coordinates of all the focused sound sources outputted from the focal-point position determination unit 12 and also receives the coordinates of all the focused sound sources in the absolute coordinate system. The filter-coefficient determination unit 13 designs a filter for each loudspeaker in the frequency domain and then performs an inverse Fourier transform on the filter to outputs an impulse response vector to be given to each loudspeaker. The filter-coefficient determination unit 13 calculate the impulse response vector for each loudspeaker by performing an inverse Fourier transform on the driving function for each loudspeaker that is used to generate a focused sound source at the position of each focused sound source and in which different weights are given to some of the focused sound sources. The filter-coefficient determination unit 13 calculates the impulse response vector, which is to be used to calculate the convolution with the input acoustic signal I, from each set of the focal point coordinates determined by the focal-point position determination unit 12, for each loudspeaker of the linear loudspeaker array.

For example, the filter-coefficient determination unit 13 calculates target frequencies from an external input or the like, and for this target frequencies, the filter-coefficient determination unit 13 calculates a driving function to be given to the loudspeaker, by using formulas 3 and 4 in which formula 2 is applied to formula 1.

The driving signal for driving a loudspeaker to be given to the loudspeaker can be designed in the frequency domain from the position $X_s=(x_s, y_s)$ of the s-th focused sound source in the absolute coordinate system and the position $X_i=(x_i, y_i)$ of the target i-th loudspeaker by using formula 1.

[Math. 1]

$$D_{2.5D}(X_i, \omega) = \frac{-jk}{2} g_0 \frac{y_i - y_s}{|X_i - X_s|} H_1^{(1)}(k|X_i - X_s|) \tag{1}$$

In the above formula, $X_i=(x_i, y_i)$ is the coordinate position of the i-th loudspeaker in the absolute coordinate system; $X_s=(x_s, y_s)$ is the coordinate position of the s-th focused sound source in the absolute coordinate system; $k=\omega/c$ is the wavenumber; $\omega$ is the angular frequency ($2\pi f$); f is the frequency; c is the speed of sound; j is $\sqrt{(-1)}$; $H_1^{(1)}$ is the first-order Hankel coefficient of the first kind; g0 is $\sqrt{(2\pi|y_s-y_i|)}$; and $|y_s-y_i|$ is the distance from the focused sound source to the loudspeaker array.

By using the driving signal obtained according to formula 2 from the circular harmonic series, it is possible to reproduce sound sources with a directional characteristic.

[Math. 2]

$$W(r_f, \phi_f) = \sum_n \frac{\check{S}^{(2)}(n, \omega)}{(-j/4) \cdot J_n(kr_f) e^{-jn\phi_f}} \tag{2}$$

In the above formula, $W(r_f, \varphi_f)$ is a weight given to the focused sound source at position $(r_f, \varphi_f)$; $S^{(2)}(n, \omega)$ is the n-th order circular harmonic series; and $J_n(kr_f)$ is the n-th order Bessel function.

The filter-coefficient determination unit 13 calculates the driving function of formula 3 from formulas 1 and 2 and uses it.

[Math. 3]

$$D_{2.5D}(X_i, \omega) = \frac{-jk}{2} g_0 \sum_{X_x} W(X_s) \frac{y_i - y_s}{|X_i - X_s|} H_1^{(1)}(k|X_i - X_s|) \tag{3}$$

In the above formula, $X_i=(x_i, y_i)$ is the coordinate position of the i-th loudspeaker in the absolute coordinate system; $X_s=(x_s, y_s)$ is the coordinate position of the s-th focused sound source in the absolute coordinate system (here, excluding $X_s$ in $\Sigma_{Xs}W(X_s)$); $W(X_s)$ is a weight given to the focused sound source at position $X_s$; and $X_s$ in $W(X_s)$ is the polar coordinate position of the s-th focused sound source in the relative coordinate system. Weight $W(X_s)$ is obtained from formula 4.

[Math. 4]

[Math. 4]

$$W(X_s) = \sum_n \frac{\check{S}^{(2)}(n, \omega)}{(-j/4) \cdot J_n(kr'_s) e^{-jn\phi'_s}} \tag{4}$$

In the above formula, $X_s=(r_s, \varphi_s)$ is the polar coordinate position of the s-th focused sound source in the relative coordinate system; $S^{(2)}(n, \omega)$ is the n-th order circular harmonic series; $J_n(kr'_f)$ is the n-th order Bessel function; and $X_s$ used in the weight calculation in formula 4 is the relative coordinates $(r_s, \varphi_s)$ of each focal point to the center of the circular array.

In summary, the filter-coefficient determination unit 13 derives the driving function expressed by formulas 3 and 4, by performing in advance, for each of the multiple focused sound sources, circular harmonic expansion on the directional characteristic of the focused sound source to obtain the n-th order circular harmonic series; dividing, for each order, the n-th order circular harmonic series by the two-dimensional Green's function subjected to circular harmonic expansion for the virtual sound source to calculate the mode strength for each order; calculating a weighting factor for each focused sound source from the sum of the mode strengths of all the orders; and calculating the weighted average of the driving functions for driving the loudspeakers with the weighting factor for each focused sound source. The above two-dimensional Green's function is publicly known and can be defined uniquely.

By calculating formula 3 over a predetermined frequency range (for example, 100 Hz≤f<2000 Hz), the filter-coefficient determination unit 13 can calculate the driving signal to be given to the i-th loudspeaker of the loudspeakers included in the linear loudspeaker array. With formula 4, by giving a different weight to each of the multiple focused sound sources based on information on the direction of the directivity inputted from the outside, it is possible to provide virtual sound sources having directivity. The filter-coefficient determination unit 13 performs this calculation for each loudspeaker of the linear loudspeaker array to determine a driving signal with directivity to be given to each loudspeaker.

The filter-coefficient determination unit 13 performs an inverse Fourier transform on the driving function expressed by formulas 3 and 4 to obtain the impulse response vector to be given to each loudspeaker.

Figure 4:
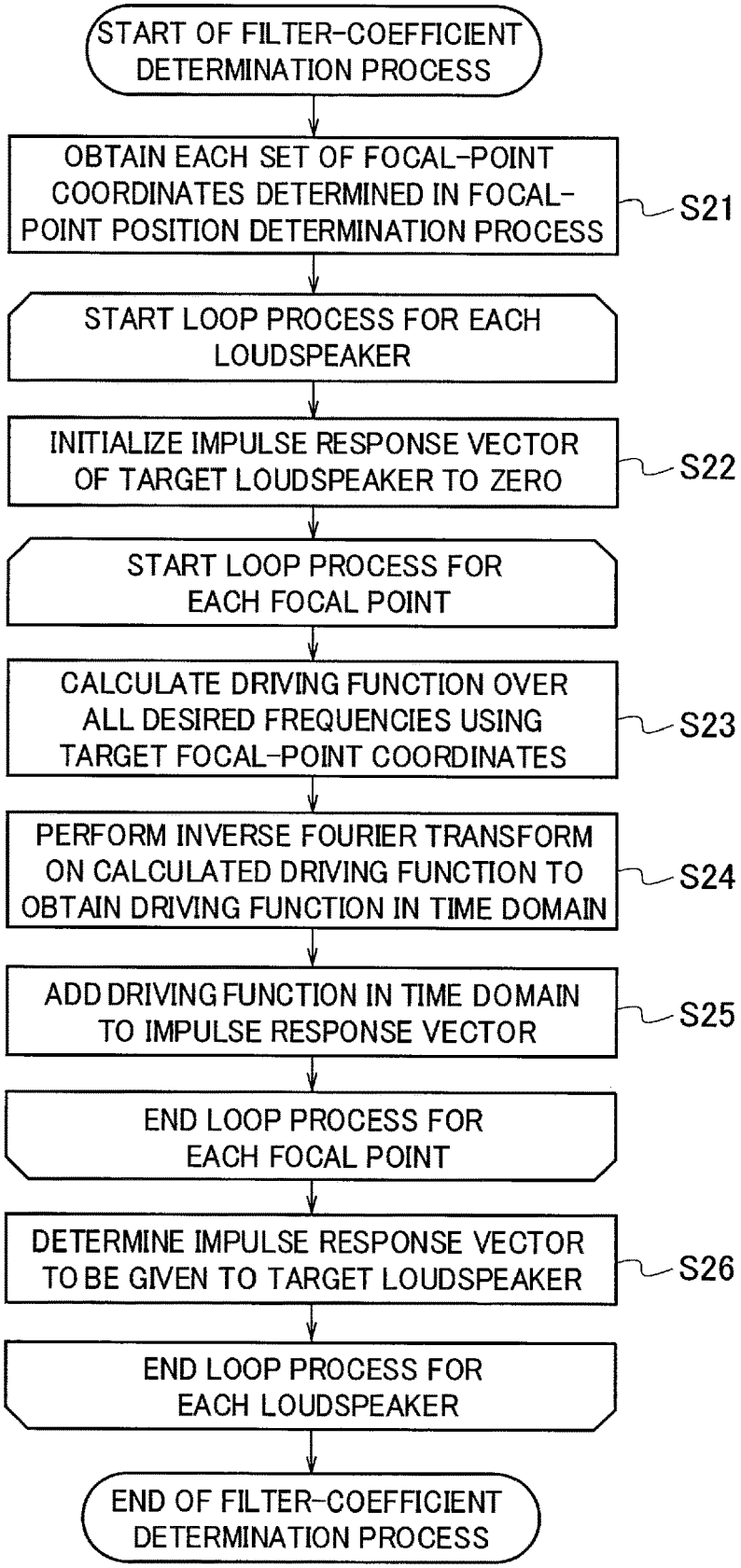
FIG. 4 is a diagram illustrating the procedure for a filter-coefficient determination process according to the first embodiment.

Next, a filter-coefficient determination process by the filter-coefficient determination unit 13 will be described. FIG. 4 is a diagram illustrating the procedure for the filter-coefficient determination process.

First, at step S21, the filter-coefficient determination unit 13 obtains each set of the focal point coordinates determined in the focal-point determination process.

The filter-coefficient determination unit 13 repeats the processes of steps S22 to S26 to calculate an impulse response vector for each loudspeaker. At step S22, the filter-coefficient determination unit 13 initializes the impulse response vector for the target loudspeaker for processing to zero.

The filter-coefficient determination unit 13, after initializing the impulse response vector at step S22, repeats the processes at steps S23 to S25 for each focal point. At step S23, using the target focal point coordinates for processing, the filter-coefficient determination unit 13 calculates the driving function expressed by formulas 3 and 4 for all the desired target frequencies. At step S24, the filter-coefficient determination unit 13 performs an inverse Fourier transform on the driving function calculated at step S23 to obtain the driving function in the time domain. At step S25, the filter-coefficient determination unit 13 adds the driving function in the time domain obtained at step S24 to the impulse response vector.

After the processes at steps S23 to S25 finish for all the focal points, the filter-coefficient determination unit 13, at step S26, determines the impulse response vector at this point as the impulse response vector to be given to the target loudspeaker.

After the processes at steps S23 to S26 finish for all the loudspeakers, the filter-coefficient determination unit 13 ends the process.

Note that the processes at step S22 to S26 only need to be performed for every loudspeaker and hence may be performed in any order. Similarly, the processes at step S23 to S25 only need to be performed for every focal point and hence may be performed in any order.

After the filter-coefficient determination unit 13 calculates the impulse response vector for each loudspeaker of the linear loudspeaker array, the convolution calculation unit 14 calculates the convolution of the input acoustic signal I with the impulse response vector to calculate the output acoustic signal O to be given to each loudspeaker.

For each loudspeaker of the linear loudspeaker array, the convolution calculation unit 14 calculates the convolution of one inputted input acoustic signal I with the impulse response vector for the loudspeaker and outputs the weighted output acoustic signal O for the loudspeaker. The convolution calculation unit 14 calculates, for a specified loudspeaker, convolution of the input acoustic signal I with the impulse response vector for this loudspeaker to obtain the weighted output acoustic signal O for this loudspeaker. The convolution calculation unit 14 repeats the same or a similar process for each loudspeaker to obtain the weighted output acoustic signal O for each loudspeaker.

Figure 5:
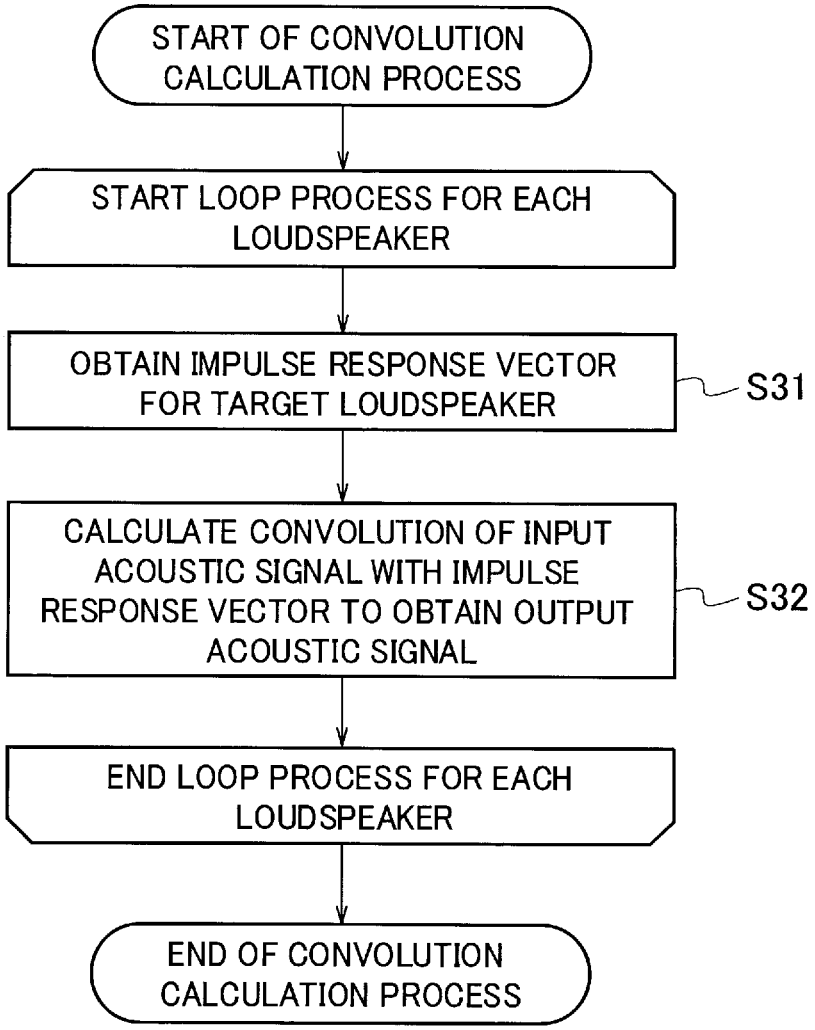
FIG. 5 is a diagram illustrating the procedure for a convolution calculation process according to the first embodiment.

Next, a convolution calculation process by the convolution calculation unit 14 will be described. FIG. 5 is a diagram illustrating the procedure for the convolution calculation process.

The convolution calculation unit 14 repeats the processes at steps S31 and S32 for each loudspeaker of the linear loudspeaker array. At step S31, the convolution calculation unit 14 obtains the impulse response vector for the target loudspeaker for processing from the filter-coefficient determination unit 13. At step S32, the convolution calculation unit 14 calculates the convolution of the input acoustic signal I with the impulse response vector obtained at step S31 to obtain the output acoustic signal O.

After the processes at step S31 to S32 finish for all the loudspeakers, the convolution calculation unit 14 ends the process. Note that the processes at step S31 and S32 only need to be performed for every loudspeaker and hence may be performed in any order.

As has been described above, since in the first embodiment, the acoustic-signal processing device (sound image reproduction device) 1 uses the driving functions that are used to generate multiple virtual sound sources in a circular arrangement and in which different weights are given to some of the virtual sound sources, the first embodiment makes it possible to provide a sound image reproduction device, sound image reproduction method, and sound image reproduction program capable of imparting directivity to virtual sound sources in a space.

In addition, since in the first embodiment, the acoustic-signal processing device 1 calculates the convolution of one inputted acoustic signal with the impulse response vector for each loudspeaker, the acoustic-signal processing device 1 can support monaural sound sources.

Second Embodiment

Described in a second embodiment is a method of providing virtual sound sources as multipole sound sources that requires only a low computational complexity, by using wave field synthesis in the time domain.

Figure 6:
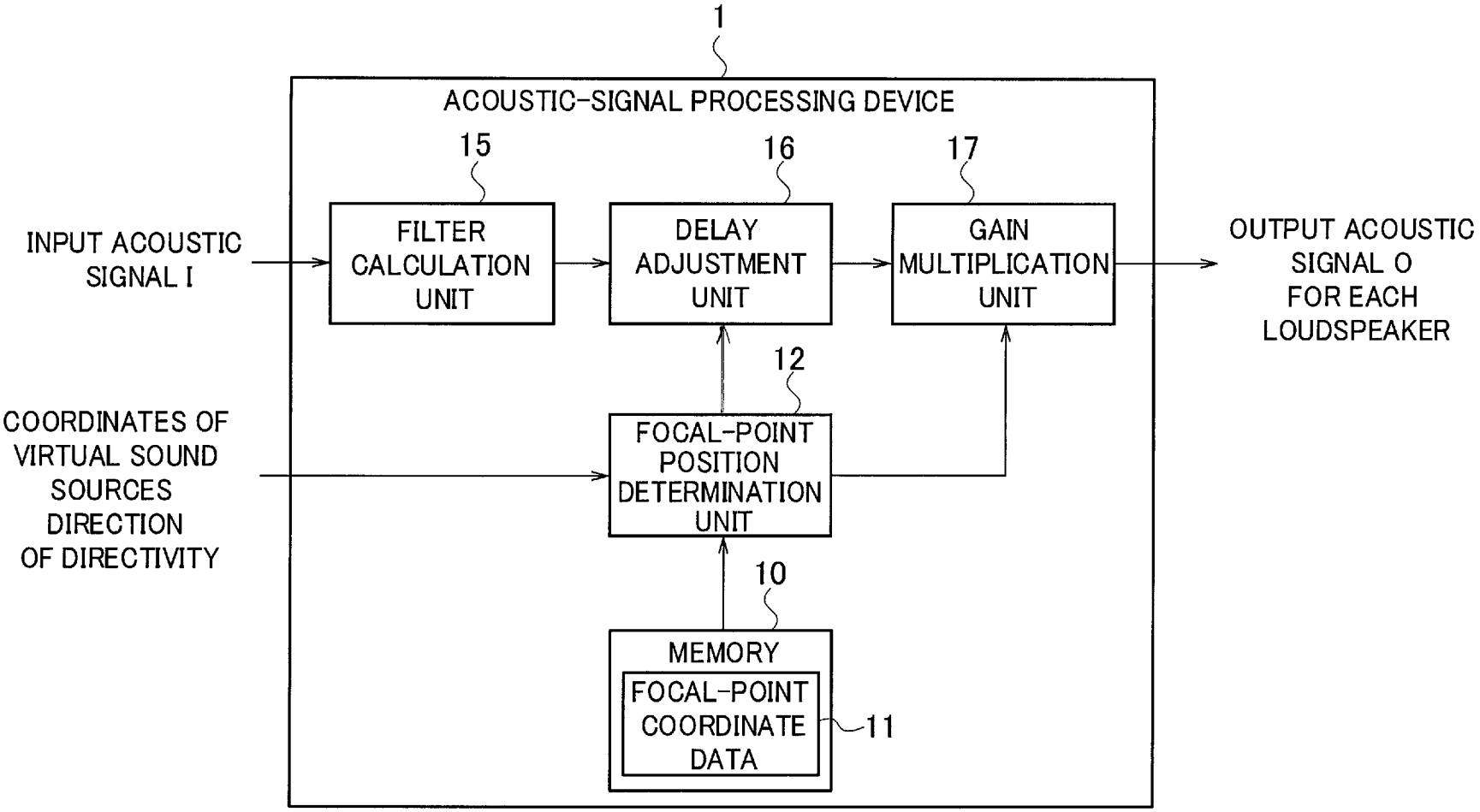
FIG. 6 is a diagram illustrating the functional block configuration of an acoustic-signal processing device according to a second embodiment.

FIG. 6 is a diagram illustrating the functional block configuration an acoustic-signal processing device 1 according to the second embodiment. The acoustic-signal processing device (sound image reproduction device) 1 includes a filter calculation unit 15, a delay adjustment unit 16, and a gain multiplication unit 17, instead of the convolution calculation unit 14 illustrated in FIG. 1, to achieve a significant reduction in computational complexity.

The acoustic-signal processing device 1 includes a memory 10, a focal-point position determination unit 12, the filter calculation unit 15, the delay adjustment unit 16, and the gain multiplication unit 17. The memory 10 and the focal-point position determination unit 12 are the same or similar to those of the first embodiment.

The filter calculation unit 15 calculates the convolution of one inputted input acoustic signal I with each of the impulse response vectors calculated in advance using formulas 3 and 4 and outputs weighted acoustic signals in a method the same or similar to the one in the first embodiment. As in the first embodiment, the filter calculation unit 15 calculates the impulse response vectors in advance using formulas 3 and 4 by the filter-coefficient determination method illustrated in FIG. 4.

Figure 7:
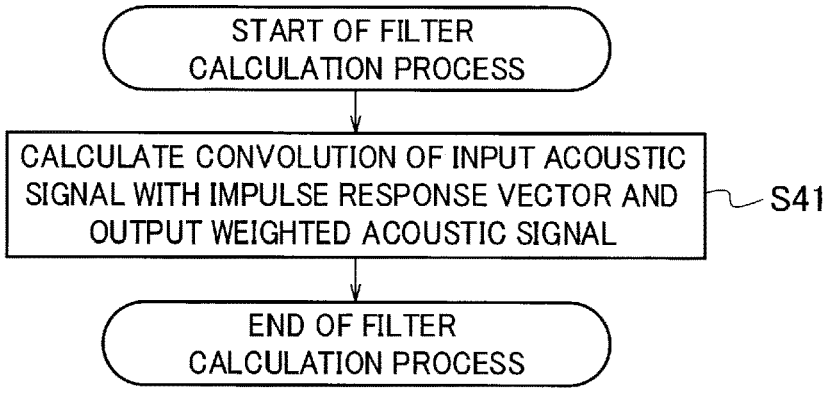
FIG. 7 is a diagram illustrating the procedure for a filter calculation process according to the second embodiment.

Next, a filter calculation process by the filter calculation unit 15 will be described. FIG. 7 is a diagram illustrating the procedure for the filter calculation process.

At step S41, the filter calculation unit 15 calculates the convolution of the input acoustic signal I with the impulse response vectors calculated in advance using formulas 3 and 4 and outputs the weighted acoustic signals.

The delay adjustment unit 16, for each loudspeaker of the linear loudspeaker array, delays the output time of the weighted acoustic signal by the time necessary for the sound to travel the distance between the loudspeaker and each of the multiple focused sound sources, and the delay adjustment unit 16 outputs the delayed acoustic signal for each of the multiple focused sound sources. The delay adjustment unit 16 calculates the delayed acoustic signal for all the focal points outputted by the focal-point position determination unit 12 using formula 5. In the formula 5, n is time.

[Math. 5]

$$\dot{s}(n)=\hat{s}(n-|X_i-X_s|/c \quad (5)$$

For each loudspeaker of the linear loudspeaker array, the gain multiplication unit 17 multiplies the delayed acoustic signal for each of the multiple focused sound sources by a gain determined by the distance between the loudspeaker and each of the multiple focused sound sources and outputs the output acoustic signal O for the loudspeaker.

For a specified loudspeaker, the gain multiplication unit 17 obtains the gain by dividing the distance between the focal point coordinates and the loudspeaker array by the distance between the focused sound source and the loudspeaker position to the power of three-seconds and multiplies the delayed acoustic signal obtained by the delay adjustment unit 16 by the gain to output the output acoustic signal O. The statement "the distance between focal point coordinates and the loudspeaker array" means the difference between the value of the loudspeaker array on the Y-axis and the value of the focal point coordinate on the Y-axis for the case where the loudspeaker array is arranged on the X-axis. The output acoustic signal O for the specified loudspeaker is obtained by formula 6. The gain multiplication unit 17 calculates the output acoustic signal O for each loudspeaker using formula 6.

[Math. 6]

$$y(n)=-g_0 y_i-y_s/|X_i-X_s|^{3/2}\cdot\dot{s}(n) \quad (6)$$

For a specified loudspeaker of the linear loudspeaker array, the delay adjustment unit 16 and the gain multiplication unit 17 perform processing of the delay adjustment unit 16 and the gain multiplication unit 17, in which a delay and a gain are set according to the position of the loudspeaker, to generate the output acoustic signal. By performing the same or a similar process, changing the loudspeaker of interest in order, the delay adjustment unit 16 and the gain multiplication unit 17 obtain the output acoustic signal O for each loudspeaker of the linear loudspeaker array.

Figure 8:
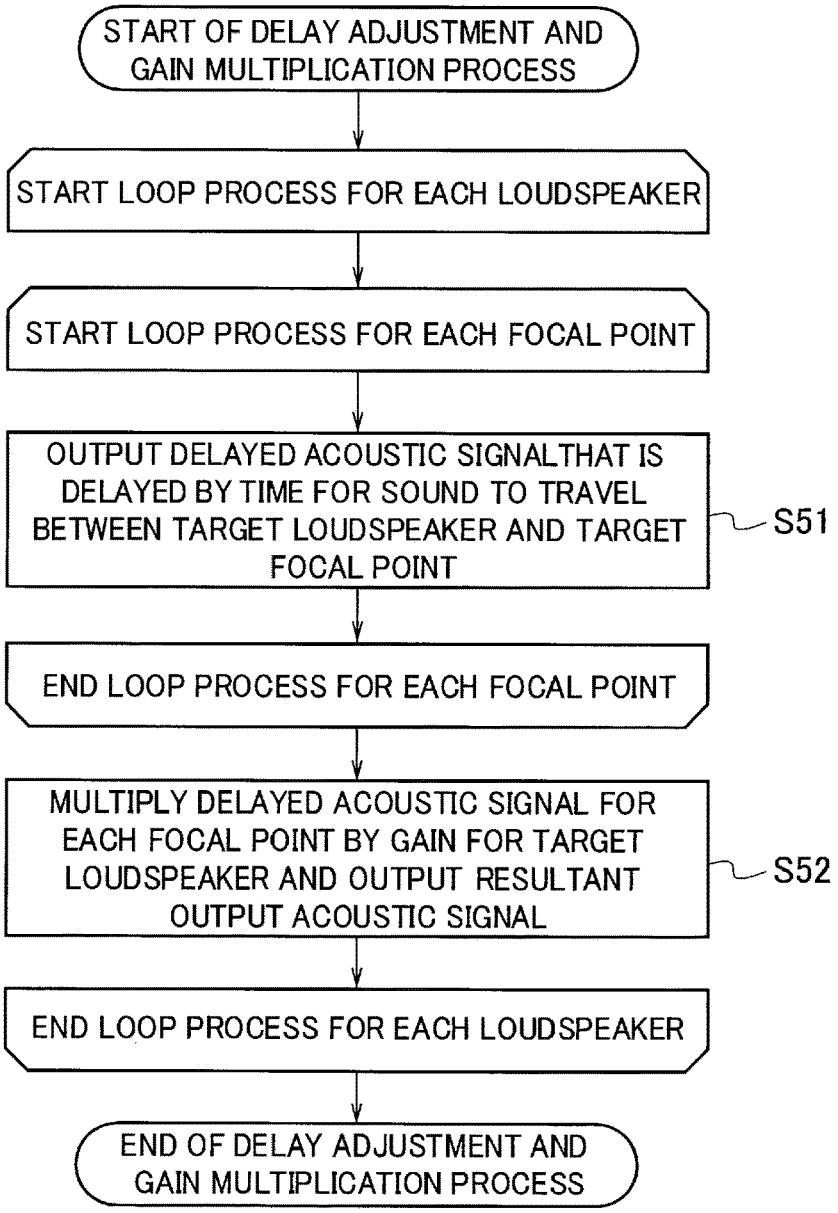
FIG. 8 is a diagram illustrating the procedure for a delay adjustment and gain multiplication process according to the second embodiment.

Next, a delay adjustment and gain multiplication process by the delay adjustment unit 16 and the gain multiplication unit 17 will be described. FIG. 8 is a diagram illustrating the procedure for the delay adjustment and gain multiplication process.

First, for each loudspeaker of the linear loudspeaker array, the acoustic-signal processing device 1 performs the processes at steps S51 and S52.

The delay adjustment unit 16 performs the process at step S51 for each focal point. At step S51, the delay adjustment unit 16 outputs the delayed acoustic signal in which the acoustic signal is delayed by the time taken for the sound to travel between the target loudspeaker and the target focal point. When the delayed acoustic signals are outputted for all the focal points, the gain multiplication unit 17, at step S52, multiplies the delayed acoustic signal calculated at step S51 for each focal point by the gain of the target loudspeaker to output the output acoustic signal O for the target loudspeaker.

After the processes at steps S51 and S52 finish for all the loudspeakers, the acoustic-signal processing device 1 ends the process.

Note that the process at step S51 only needs to be performed for every focal point and hence may be performed in any order. Similarly, the process at step S52 only needs to be performed for every loudspeaker and hence may be performed in any order. Depending on the process environment or the like, specified processes may be performed in parallel.

As has been described above, since in the second embodiment, the impulse response vectors are calculated in advance, what needs to be done is only adding the power multiplication (gain) and delay for each loudspeaker, and thus the computational complexity is reduced dramatically.

Also for the second embodiment, since the acoustic-signal processing device (sound image reproduction device) 1 uses the driving functions that are used to generate multiple virtual sound sources in a circular arrangement and in which different weights are given to some of the virtual sound sources, the second embodiment makes it possible to provide a sound image reproduction device, sound image reproduction method, and sound image reproduction program capable of imparting directivity to virtual sound sources in a space.

In addition, also in the second embodiment, since the acoustic-signal processing device 1 calculates the convolution of one inputted acoustic signal with the impulse response vector for each loudspeaker, the acoustic-signal processing device 1 can support monaural sound sources.

Other Embodiments

Although the present invention has been described based on the first and second embodiments as above, it should not be understood that the descriptions and drawings constituting part of this disclosure limit this invention. From this disclosure, those skilled in the art easily will understand various alternative embodiments, examples, and operational techniques.

The present invention naturally includes various embodiments and the like not described herein. Thus, the technical scope of the present invention is determined only by the matters used to define the invention according to the claims, relevant to the above description.

EXPLANATION OF THE REFERENCE NUMERALS

1 acoustic-signal processing device (sound image reproduction device)
10 memory
11 focal-point coordinate data
12 focal-point position determination unit
13 filter-coefficient determination unit
14 convolution calculation unit
15 filter calculation unit
16 delay adjustment unit
17 gain multiplication unit

The invention claimed is:

1. A sound image reproduction device configured to generate virtual sound sources in a space using multiple loudspeakers arranged in a straight line, comprising:

a focal-point position determination unit configured to determine a position of each virtual sound source to generate multiple virtual sound sources in a circular arrangement;

a filter-coefficient determination unit configured to calculate an impulse response vector for each loudspeaker by performing an inverse Fourier transform on a driving function for each loudspeaker that is used to generate a virtual sound source at the position of each virtual sound source and in which different weights are given to some of the virtual sound sources; and a convolution calculation unit configured to calculate a convolution of one inputted acoustic signal with the impulse response vector for each loudspeaker and output each acoustic signal to corresponding multiple loudspeakers, wherein the driving function is obtained by:

performing, in advance, circular harmonic expansion on directional characteristics of the virtual sound sources for the multiple virtual sound sources to obtain an n-th order circular harmonic series, dividing, for each order, the n-th order circular harmonic series by a two-dimensional Green's function subjected to circular harmonic expansion for the virtual sound sources, summing values from the division to calculate a weighting factor for each virtual sound source, and calculating a weighted average of the driving functions for driving the loudspeakers with the weighting factor for each virtual sound source.

2. A sound image reproduction method of generating virtual sound sources, performed by a sound image reproduction device, in a space using multiple loudspeakers arranged in a straight line, comprising:

determining a position of each virtual sound source to generate multiple virtual sound sources in a circular arrangement;

calculating an impulse response vector for each loudspeaker by performing an inverse Fourier transform on a driving function for each loudspeaker that is used to generate a virtual sound source at a position of each virtual sound source and in which different weights are given to some of the virtual sound sources; and calculating a convolution of one inputted acoustic signal with the impulse response vector for each loudspeaker and outputting each acoustic signal to corresponding multiple loudspeakers, wherein the driving function is obtained by:

performing, in advance, circular harmonic expansion on directional characteristics of the virtual sound sources for the multiple virtual sound sources to obtain an n-th order circular harmonic series, dividing, for each order, the n-th order circular harmonic series by a two-dimensional Green's function subjected to circular harmonic expansion for the virtual sound sources, summing values from the division to calculate a weighting factor for each virtual sound source, and calculating a weighted average of the driving functions for driving the loudspeakers with the weighting factor for each virtual sound source.

3. A non-transitory recording medium storing a sound image reproduction program, wherein executing of the sound image reproduction program causes one or more computers to perform operations comprising:

determining a position of each virtual sound source to generate multiple virtual sound sources in a circular arrangement;

calculating an impulse response vector for each loudspeaker by performing an inverse Fourier transform on a driving function for each loudspeaker that is used to generate a virtual sound source at a position of each virtual sound source and in which different weights are given to some of the virtual sound sources; and calculating a convolution of one inputted acoustic signal with the impulse response vector for each loudspeaker and outputting each acoustic signal to corresponding multiple loudspeakers, wherein the driving function is obtained by:

performing, in advance, circular harmonic expansion on directional characteristics of the virtual sound sources for the multiple virtual sound sources to obtain an n-th order circular harmonic series, dividing, for each order, the n-th order circular harmonic series by a two-dimensional Green's function subjected to circular harmonic expansion for the virtual sound sources, summing values from the division to calculate a weighting factor for each virtual sound source, and calculating a weighted average of the driving functions for driving the loudspeakers with the weighting factor for each virtual sound source.

4. A sound image reproduction device configured to generate virtual sound sources in a space using multiple loudspeakers arranged in a straight line, comprising:

a focal-point position determination unit configured to determine a position of each virtual sound source to generate multiple virtual sound sources in a circular arrangement;

a filter calculation unit configured to output weighted acoustic signals by calculating a convolution of one inputted acoustic signal with an impulse response vector for each loudspeaker calculated in advance by performing an inverse Fourier transform on a driving function for each loudspeaker that is used to generate a virtual sound source at the position of each virtual sound source and in which different weights are given to some of the virtual sound sources;

a delay adjustment unit configured to, for each loudspeaker, delay the output time of the weighted acoustic signal by the time necessary for the sound to travel a distance between the loudspeaker and each of the multiple virtual sound sources and output the delayed acoustic signal for each of the multiple virtual sound sources; and a gain multiplication unit configured to, for each loudspeaker, multiply the delayed acoustic signal for each of the multiple virtual sound sources by a gain determined by the distance between the loudspeaker and each of the multiple virtual sound sources and output the multiplication result, wherein the driving function is obtained by:

performing, in advance, circular harmonic expansion on directional characteristics of the virtual sound sources for the multiple virtual sound sources to obtain an n-th order circular harmonic series, dividing, for each order, the n-th order circular harmonic series by a two-dimensional Green's function subjected to circular harmonic expansion for the virtual sound sources, summing values from the division to calculate a weighting factor for each virtual sound source, and calculating a weighted average of the driving functions for driving the loudspeakers with the weighting factor for each virtual sound source.

5. A sound image reproduction method of generating virtual sound sources, performed by a sound image reproduction device, in a space using multiple loudspeakers arranged in a straight line, comprising:

determining a position of virtual sound source to generate multiple virtual sound sources in a circular arrangement;

outputting weighted acoustic signals by calculating a convolution of one inputted acoustic signal with an impulse response vector for each loudspeaker calculated in advance by performing an inverse Fourier transform on a driving function for each loudspeaker that is used to generate a virtual sound source at the position of each virtual sound source and in which different weights are given to some of the virtual sound sources;

delaying, for each loudspeaker, output time of the weighted acoustic signal by time necessary for the sound to travel a distance between the loudspeaker and each of the multiple virtual sound sources and outputting the delayed acoustic signal for each of the multiple virtual sound sources; and multiplying, for each loudspeaker, the delayed acoustic signal for each of the multiple virtual sound sources by a gain determined by the distance between the loudspeaker and each of the multiple virtual sound sources and outputting the multiplication result, wherein the driving function is obtained by:

performing, in advance, circular harmonic expansion on directional characteristics of the virtual sound sources for the multiple virtual sound sources to obtain an n-th order circular harmonic series, dividing, for each order, the n-th order circular harmonic series by a two-dimensional Green's function subjected to circular harmonic expansion for the virtual sound sources, summing values from the division to calculate a weighting factor for each virtual sound source, and calculating a weighted average of the driving functions for driving the loudspeakers with the weighting factor for each virtual sound source.

6. A non-transitory recording medium storing a sound image reproduction program, wherein executing of the sound image reproduction program causes one or more computers to perform operations comprising:

determining a position of virtual sound source to generate multiple virtual sound sources in a circular arrangement;

outputting weighted acoustic signals by calculating a convolution of one inputted acoustic signal with an impulse response vector for each loudspeaker calculated in advance by performing an inverse Fourier transform on a driving function for each loudspeaker that is used to generate a virtual sound source at the position of each virtual sound source and in which different weights are given to some of the virtual sound sources;

delaying, for each loudspeaker, output time of the weighted acoustic signal by time necessary for the sound to travel a distance between the loudspeaker and each of the multiple virtual sound sources and outputting the delayed acoustic signal for each of the multiple virtual sound sources; and multiplying, for each loudspeaker, the delayed acoustic signal for each of the multiple virtual sound sources by a gain determined by the distance between the loudspeaker and each of the multiple virtual sound sources and outputting the multiplication result, wherein the driving function is obtained by:

performing, in advance, circular harmonic expansion on directional characteristics of the virtual sound sources for the multiple virtual sound sources to obtain an n-th order circular harmonic series, dividing, for each order, the n-th order circular harmonic series by a two-dimensional Green's function subjected to circular harmonic expansion for the virtual sound sources, summing values from the division to calculate a weighting factor for each virtual sound source, and calculating a weighted average of the driving functions for driving the loudspeakers with the weighting factor for each virtual sound source.

* * * * *